US011407017B2

(12) United States Patent
Del Fabro

(10) Patent No.: US 11,407,017 B2
(45) Date of Patent: Aug. 9, 2022

(54) MACHINE AND METHOD FOR BENDING OBLONG ELEMENTS, PREFERABLY METAL, SUCH AS BARS, ROD, SECTION BARS OR SUCHLIKE

(71) Applicant: M.E.P. Macchine Elettroniche Piegatrici S.P.A., Reana del Rojale (IT)

(72) Inventor: Giorgio Del Fabro, Udine (IT)

(73) Assignee: M.E.P. MACCHINE ELETTRONICHE PIEGATRICI S.P.A., Reana del Rojale (IT)

( * ) Notice: Subject to any disclaimer, the term of this patent is extended or adjusted under 35 U.S.C. 154(b) by 283 days.

(21) Appl. No.: 16/637,439

(22) PCT Filed: Aug. 8, 2018

(86) PCT No.: PCT/IT2018/050150
§ 371 (c)(1),
(2) Date: Feb. 7, 2020

(87) PCT Pub. No.: WO2019/030789
PCT Pub. Date: Feb. 14, 2019

(65) Prior Publication Data

US 2020/0222964 A1 Jul. 16, 2020

(30) Foreign Application Priority Data

Aug. 9, 2017 (IT) ..... 102017000092356

(51) Int. Cl.
*B21D 11/12* (2006.01)
*B21D 7/12* (2006.01)
(Continued)

(52) U.S. Cl.
CPC ..... *B21D 11/12* (2013.01); *B21D 7/12* (2013.01); *B21D 7/022* (2013.01); *B21D 43/006* (2013.01); *B21D 43/285* (2013.01); *B21F 1/00* (2013.01)

(58) Field of Classification Search
CPC ..... B21D 7/02; B21D 7/022; B21D 7/024; B21D 7/08; B21D 11/12; B21F 1/00; B21F 1/04
(Continued)

(56) References Cited

U.S. PATENT DOCUMENTS 1,837,196 A * 12/1931 Berges ..... B21D 11/12 72/133
2019/0167329 A1* 6/2019 Crawford ..... B21D 7/14

FOREIGN PATENT DOCUMENTS

EP 0379030 A1 7/1990
EP 2699366 B1 * 6/2016 ..... B21D 7/022
(Continued)

OTHER PUBLICATIONS

Int'l Search Report and Written Opinion dated Nov. 27, 2018 in Int'l Application No. PCT/IT2018/050150.

*Primary Examiner* — Jessica Cahill
*Assistant Examiner* — Jared O Brown
(74) *Attorney, Agent, or Firm* — Panitch Schwarze Belisario & Nadel LLP

(57) ABSTRACT

A machine for bending oblong elements, preferably metal, includes a feed unit configured to feed at least one of the oblong elements along a longitudinal axis. A bending device is located downstream of the feed unit and a curving unit is disposed downstream of the bending device and is configured to curve the oblong element along part of its oblong development.

7 Claims, 8 Drawing Sheets

(51) Int. Cl.

| | |
|---|---|
| ***B21D 7/022*** | (2006.01) |
| ***B21D 43/00*** | (2006.01) |
| ***B21D 43/28*** | (2006.01) |
| ***B21F 1/00*** | (2006.01) |

(58) Field of Classification Search
USPC ..... 72/170–173, 306, 307, 387, 388, 168, 72/169
See application file for complete search history.

(56) References Cited

FOREIGN PATENT DOCUMENTS

| | | | | | |
|---|---|---|---|---|---|
| EP | 2699366 | B1 | | 6/2016 | |
| FR | 2704784 | A3 | * | 11/1994 | ..... B21D 11/12 |
| WO | 03045603 | A1 | | 6/2003 | |
| WO | 2017033145 | A1 | | 3/2017 | |

* cited by examiner 10
11
19
20
21
22
23
24
25
28
29
30
31
32
34
35
R1
R2
T
X
Y
Z
C
F1
F2

10
11
21
25
28
29
30
31
32
34
35
C
F2
R1
R2
T
X
Y
Z

T
R1
R2
11
F2
34
29
30
32
35
28
31
21
Y
C
Z
25
X
10

10
19
20
25
C
Z
21
26
27
20
29
31
30
32
30
28
T 10
19
20
24
X
25
21
C
23
22
Z
Y
26
27
20
29
31
30
32
30
28
T 10
19
20
X
Z
21
26
27
20
C
29
31
30
32
30
28
F1
T

MACHINE AND METHOD FOR BENDING OBLONG ELEMENTS, PREFERABLY METAL, SUCH AS BARS, ROD, SECTION BARS OR SUCHLIKE

CROSS-REFERENCE TO RELATED APPLICATIONS

This application is a Section 371 of International Application No. PCT/IT2018/050150, filed Aug. 8, 2018, which was published in the English language on Feb. 14, 2019, under International Publication No. WO 2019/030789 A1, which claims priority under 35 U.S.C. § 119(b) to Italian Application No. 102017000092356, filed Aug. 9, 2017, the disclosures of each of which are incorporated herein by reference in their entireties.

FIELD OF THE INVENTION

The field of application of the present invention is that of industrial machines and processes for bending oblong elements, preferably metal, in which their length, which can even be several tens of meters, is of different orders of magnitude greater than their transverse size, such as for example bars, rod and section bars, or suchlike. A particular application of the present invention, even if it is not limited to this, concerns the bending of so-called reinforcement bars for reinforced concrete.

BACKGROUND OF THE INVENTION

In the field of industrial machines and processes for bending oblong metal elements, the Applicant has developed several innovative solutions in recent decades, which have also been disclosed through various patent documents, such as for example the international patent applications published under the numbers WO-A-03/045603, WO-A-2009/077554, WO-A-2009/068529, WO-A-2009/135845, WO-A-2011/064222 and WO-A-2017/033145, as well as the European patent applications EP-A-0379030 and EP-A-3151985.

In particular, EP-A-3151985 describes a machine and a method for curving one or more bars, even simultaneously, having different characterizations and nominal diameters. The machine described in EP-A-3151985 comprises both a support bench, which is configured to support the bars to be bent and has an oblong development in relation to the length of the bars, and also two autonomous curving units, mobile in a controlled manner along the same reference axis, parallel to the support bench, each independently of the other, to curve the bars, that is, to deform them so as to curve them. Each of the two curving units comprises a pair of contrast rolls, between which the bars to be bent pass, and a curving roll disposed in an external position with respect to the pair of contrast rolls and configured to obtain a predefined curvature, with selectable radii of curvature and which can be constant and/or variable, on each bar located between the two contrast rolls, by deforming each bar with respect to the latter.

WO-A-2017/033145 describes a machine and a bending method to bend, curve or shape one or more rods of any type and shape and thus obtain curved metal products, that is, having at least one of their parts curved. The machine described in WO-A-2017/033145 comprises a support bench provided with clamping members to temporarily clamp the rods to be bent and configured to support and guide, along the same axis of movement, two linearly sliding sliders. Each slider is provided with a work plane on which a corresponding curving unit is operative, similar to those described in EP-A-3151985, and therefore also able to curve the rods with determinate selectable radii of curvature, constant and/or variable, which can even be very large. Moreover, on the work plane of each slider, in determinate fixed positions, there are also one or more bending units, for example of the type described in EP-A-0379030, each of which is associated with the corresponding curving unit mounted on the same slider. In particular, each bending unit comprises a central contrast roll and a radial pin rotatable around the central contrast roll to bend the rods with a predefined determinate radius of curvature, which corresponds to the radius of the central contrast roll.

The above known machines, although reliable, have however the limit that, on the one hand, each curving unit is not able to make bends with very small radii of curvature and, on the other hand, each bending unit is used only to make bends with relatively small radii of curvature, that is, corresponding to the radius of the central contrast roll. Moreover, in the machine described in WO-A-2017/033145 each rod being worked must be translated from a first position in which it lies in the axis of movement of the sliders, to a second position substantially parallel to the first, in which the bending units can make the bends on the oblong element.

Another disadvantage of the above known machines is that they are particularly bulky and complex to manage.

A first purpose of the present invention is to obviate the disadvantages of known machines and methods by making a bending machine and perfecting the corresponding method, which are able to bend oblong elements, both to make bends, for example in correspondence with the head and/or tail end of the oblong element, with predetermined and relatively small radii of curvature, for example comprised between 20 mm and 200 mm, and also to make proper curves, even small, or merely outlined, that is, with radii of curvature from medium to large, comprised in a very wide range of values, for example from a few centimeters up to more than tens or hundreds of meters, throughout the length of the oblong element, or in part of it.

Another purpose of the present invention is to provide a bending machine and perfect the corresponding method, which are very versatile and reliable to obtain oblong elements with different bends and/or curves, according to the client's requests, or to the requirements of the other fields for which the oblong elements are intended, for example that of buildings or infrastructures.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purposes, a machine for bending oblong elements, preferably but not only, metal, such as bars, rods, section bars, or suchlike, according to the present invention, comprises:

a feed unit configured to feed at least one of said oblong elements along a longitudinal axis, a support structure provided with lateral guides parallel to a transverse axis, perpendicular to the longitudinal axis, and a bending device installed on the support structure, selectively translatable along the lateral guides, located downstream of the feed unit and provided with a contrast roll and a bending pin selectively rotatable around the contrast roll to at least bend the oblong element around the contrast roll.

According to one aspect of the present invention, the machine according to the above purposes comprises a curving unit disposed downstream of the bending device and configured to curve the oblong element along part of its oblong development.

Embodiments of the present invention also concern a method for bending oblong elements, preferably metal, which comprises feeding, with a feed unit, at least one of the oblong elements along a longitudinal axis, and bending the oblong element around a contrast roll by the action of a bending pin which is made to rotate around the contrast roll.

The contrast roll and the bending pin are part of a bending device translatable along lateral guides of a support structure and parallel to a transverse axis, perpendicular to the longitudinal axis.

According to a possible solution, the method also comprises curving the oblong element along part of its oblong development, by means of a curving unit located downstream of the bending device.

Other embodiments of the invention provide that the oblong element is positioned in the interspace comprised between the contrast roll and the bending pin, and the latter is made to rotate with respect to the contrast roll, to exert a deformation force on the oblong element in a direction transverse to the longitudinal axis, and around the contrast roll. Moreover, while the bending pin acts on the oblong element, the latter is moved in a direction parallel to the longitudinal axis, by the action of the feed unit, to exert a deformation which extends along at least part of the length of the oblong element.

BRIEF DESCRIPTION OF THE DRAWINGS

These and other characteristics of the present invention will become apparent from the following description of some embodiments, given as a non-restrictive example with reference to the attached drawings wherein.

We must clarify that in the following description of some embodiments of the present invention, the same reference numbers indicate identical or very similar parts.

DETAILED DESCRIPTION OF SOME EMBODIMENTS

Figure 1:
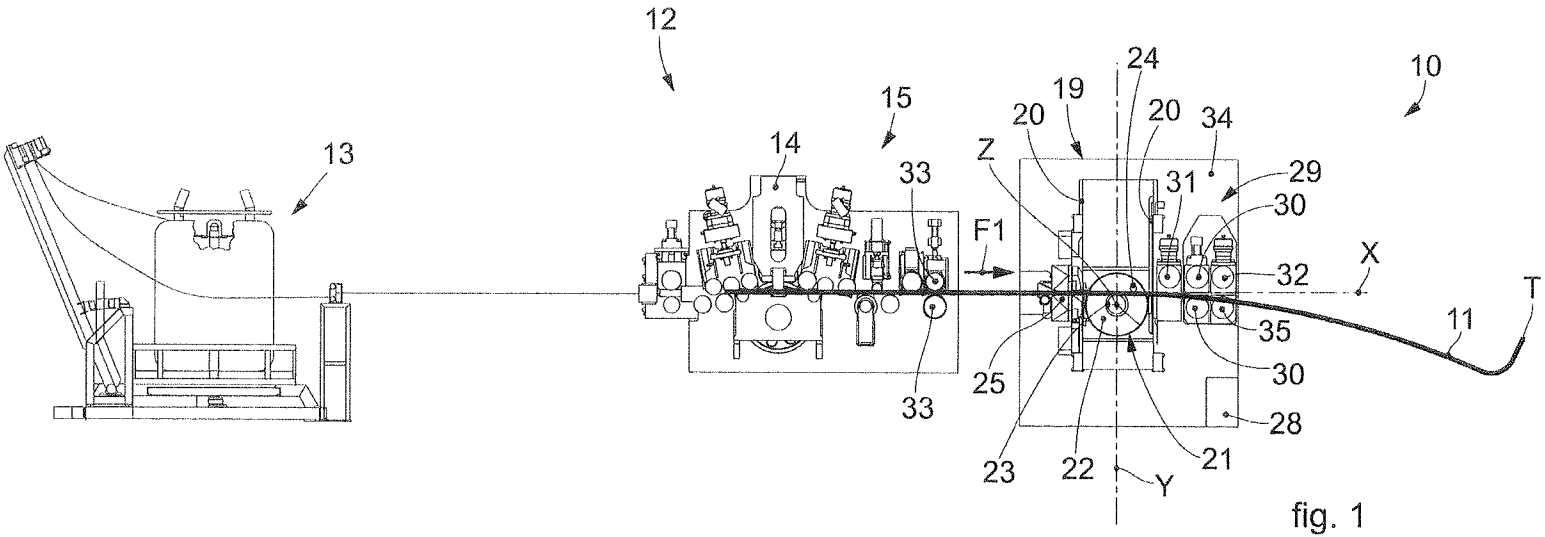
FIG. 1 is a schematic front view of a machine for bending oblong elements according to the present invention and in accordance with a first embodiment.

With reference to the attached drawings, a machine 10 according to the present invention is used to bend oblong elements 11, as defined above, such as bars, rods, section bars, or suchlike.

According to the present invention, the machine 10 comprises a feed unit 15, 18 configured to feed at least one of the oblong elements 11 along a longitudinal axis X, which defines the working axis, that is, the axis of longitudinal development of the machine 10.

The feed unit 15, 18 can comprise at least one pair of drawing rolls 33, that is, a drawing unit, opposite each other and positioned on one side and the other with respect to the longitudinal axis X in order to exert a drawing and feed action on the oblong element 11.

The drawing rolls 33 can be configured to move the oblong element 11 in both directions, and to constrain their position, that is, to clamp the position of the oblong element 11 with respect to the longitudinal axis X.

According to a first embodiment of the invention (FIG. 1), the feed unit 15 can comprise a winding reel 13, of a known type, in which the threadlike oblong element 11, for example of metal, is wound in spirals.

The feed unit 15 can also comprise a straightening unit 14 located downstream of the winding reel 13, and upstream with respect to the drawing rolls 33, and configured to straighten the oblong element 11 before feeding it downstream.

In accordance with the embodiment shown in FIG. 1, a first working plant 12 is therefore defined, configured to work oblong elements 11 obtained by cutting a wire wound in a coil, also referred to in the sector as a coil working plant.

Figure 12:
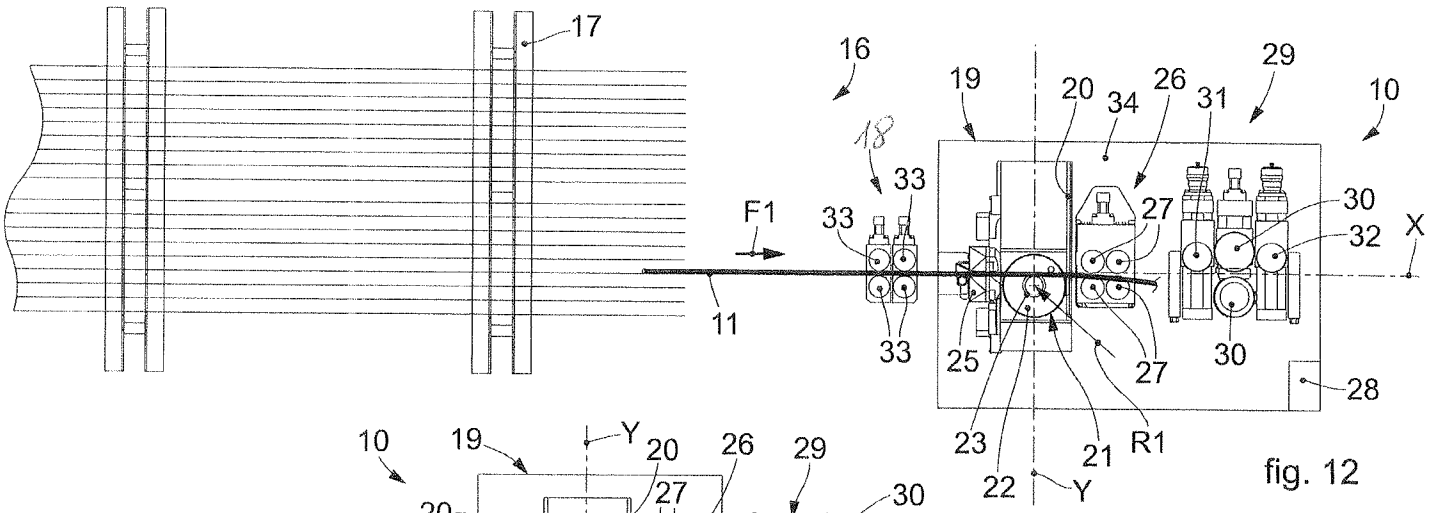
FIG. 12 is a schematic front view of a variant of the machine in FIG. 1.

In accordance with the variant embodiment in FIG. 12, the feed unit 18 comprises a storage magazine 17 in which the oblong elements 11 to be worked, already straightened and having a predetermined length, are temporarily stored.

In accordance with the embodiment shown in FIG. 12, therefore, a second working plant 16 is defined, configured to work pre-cut oblong elements 11, also referred to in the sector as a bar working plant.

According to a possible solution of the invention (FIGS. 1 and 12), the machine 10 comprises a support structure 19 provided with lateral guides 20 parallel to a transverse axis Y, which is perpendicular to the longitudinal axis X.

The support structure 19 also defines a substantially flat work plane 34 and with respect to which operations are performed on the oblong element 11.

According to a possible solution, the longitudinal axis X and the transverse axis Y lie on the work plane 34 defined by the support structure 19.

The support structure 19 can be configured to support the drawing rolls 33 as well.

A bending device 21 configured to at least bend the oblong element 11 is slidably mounted on the lateral guides 20.

The bending device 21 can be of a known type, for example of the type described in EP-A-0379030.

The bending device 21 is installed downstream of the feed unit 15, 18 of the machine 10 according to the present invention.

Moreover, in possible solutions, the bending device 21 can be installed in a fixed position with respect to the longitudinal axis X, while it can be mobile, for example, along the other axes coordinated with respect to the longitudinal axis X.

In particular, it can be provided that the bending device 21 comprises a contrast roll 23 and a bending pin 24 selectively rotatable around the contrast roll 23 to bend the oblong element 11 around the contrast roll 23.

The bending pin 24 is selectively rotatable around an axis of rotation Z which is substantially perpendicular to the longitudinal axis X. The contrast roll 23 can be located substantially coaxial with the axis of rotation Z.

Between the contrast roll 23 and the bending pin 24 an interspace is defined on each occasion, in which the oblong element 11 to be worked is positioned.

In particular, by bending, here and hereafter in the description, we mean that the oblong element 11 is subjected to a localized deformation only in the zone in which the oblong element 11 cooperates with the counter-roll 23. When the bending device 21 is driven, the oblong element 11 is kept in a fixed position and there is no translation thereof in a direction parallel to the longitudinal axis X.

According to a possible solution, the bending device 21 can comprise a disc 22, mounted rotatably around the axis of rotation Z.

The contrast roll 23 is installed on the disc 22, and is located coaxial to the axis of rotation Z, and the bending pin 24 is installed in a radial position with respect to the contrast roll 23.

According to a possible solution, the contrast roll 23 can have a determinate radius R1, relatively small, for example between 20 mm and 200 mm, which defines a so-called bending radius.

The bending pin 24, or in this case the disc 22, is associated with a motor member, not visible in the drawing, configured to make the bending pin 24 selectively rotate around the axis of rotation Z in both directions of rotation, that is, around the contrast roll 23.

The rotation of the bending pin 24 can also be of an angle chosen as desired, even very small, less than one degree, up to about 180°, depending on the need to bend and/or curve the oblong element 11 being worked, as will be described later in greater detail. In accordance with a possible embodiment of the present invention, the bending device 21, in combination with the feed unit 15, 18, can also be configured to perform curving operations on the oblong element 11.

In particular, here and hereafter in the description by the term curve we mean that the oblong element 11 is subjected to a continuous deformation for an extended longitudinal portion of the length of the oblong element 11, for example for at least 20 cm or for its entire length. During the curving operations, the oblong element 11 is moved in a direction parallel to the longitudinal axis X, while a deformation force of the oblong element 11 is exerted in a direction transverse to the longitudinal axis X.

When it is intended to make a curve with the bending device 21, the oblong element 11 is positioned in the interspace comprised between the contrast roll 23 and the bending pin 24, and the latter is made to rotate with respect to the contrast roll 23, in order to exert on the oblong element 11 a deformation force in a direction transverse to the longitudinal axis X, around the contrast roll 23. While the bending pin 24 is acting on the oblong element 11, the latter is moved in a direction parallel to the longitudinal axis X, by the action of the feed unit 15, 18, to exert a deformation which extends along at least part of the length of the oblong element 11.

In accordance with another solution of the invention, the bending device 21 is selectively mobile in a direction parallel to the axis of rotation Z between an operative position, in which the bending device 21 protrudes from the work plane 34 of the support structure 19, and an inoperative position, in which the bending device 21 is located retracted under the work plane 34.

In particular, it can be provided that in the operative position the plane of the disc 22 lies on the work plane 34 of the oblong elements 11, and in the inoperative position, in which the contrast roll 23 and the bending pin 24 are distanced from the work plane 34 and do not interfere with the oblong element 11 being worked.

Figure 2:
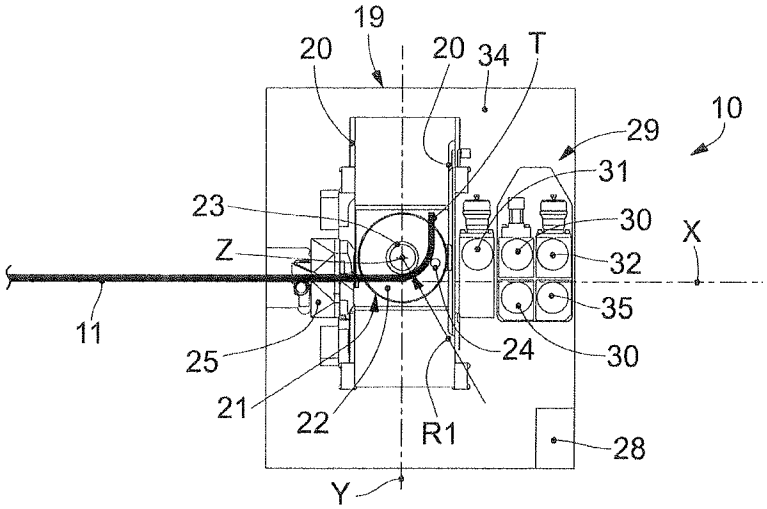
FIGS. 2 to 11 are schematic front views of the machine in FIG. 1, in accordance with a first embodiment.

According to another embodiment of the invention, the machine 10 can comprise a cutting device 25 disposed upstream of the bending device 21 with respect to the direction of feed of the oblong elements 11, which in FIGS. 1 and 2 is from left to right, as indicated by the arrow F1. The cutting device 25 can comprise, for example, a shear able to cut, even on the fly, the oblong element 11 being worked.

The cutting device 25 can be installed on the support structure 19 and disposed between the feed unit 15, 18 and the bending device 21.

According to one aspect of the present invention, the machine 10 comprises a curving unit 29 located downstream of the bending device 21 and configured to curve the oblong element 11 along its longitudinal development.

The curving unit 29 can be installed on the support structure 19.

In accordance with a possible solution, the deformation action exerted by the curving unit 29 takes place substantially continuously along the entire length of the longitudinal portion affected by the curvature.

According to a possible embodiment, the curving unit 29 can be configured to move the oblong element 11 along the longitudinal axis X, and to deform it by a deformation force exerted in a direction transverse to the longitudinal axis X.

According to another embodiment of the invention (FIGS. 1 and 12), the curving unit 29 can be positioned aligned with the bending device 21 along the longitudinal axis X.

In accordance with another embodiment of the present invention, the curving unit 29 comprises two feed rolls 30, disposed one on one side and one on the other side of the longitudinal axis X, and configured to move the oblong element 11 being worked along the longitudinal axis X, in both directions F1 and F2, or to clamp or not interfere with the oblong element 11.

The curving unit 29 also comprises at least one curving roll 31, 32 disposed adjacent to one of the two feed rolls 30 and mobile at least in a direction parallel to the transverse axis Y to impart to the oblong element 11 being worked a thrust suitable to curve it with respect to one of the two feed rolls 30 and to confer upon it the curvature having a variable radius of curvature R2.

According to a possible solution (FIGS. 1 and 12), the curving unit 29 comprises two curving rolls 31, 32, located one upstream and one downstream of the feed rolls 30, along the longitudinal axis X, and each mobile individually at least in a direction parallel to the transverse axis Y. The presence of curving rolls 31, 32 on one side and the other with respect to the feed rolls 30 allows to make curves both on the part of the oblong element 11 which is located upstream and also on the one which lies downstream of the feed rolls 30.

According to a possible solution of the invention (FIG. 1), a support roll 35 is associated with at least one of the two curving rolls 31, 32, in the case shown here with the curving roll 32, opposite to the curving roll 32 and to the longitudinal axis X, and configured to support the oblong element 11 during curving.

According to possible solutions, the support roll 35 can be selectively translatable in a direction parallel to the axis of rotation Z, to move into a retracted condition with respect to the work plane 34 and not interfering with the oblong element 11.

According to another embodiment of the present invention (FIGS. 1 and 12), the at least one curving roll 31, 32, in this case both the curving rolls 31 and 32, can be positioned both above and also below the longitudinal axis X by translation in a direction parallel to the transverse axis Y. For this purpose, movement members can be associated with the curving roll 31, 32 to allow said translation.

According to this embodiment of the invention, if the curving unit 29 comprises two curving rolls 31, 32, the latter can be alternated in the function of curving roll and contrast roll.

For example, if the curving roll 31 located upstream is exerting pressure on the oblong element 11 being worked to curve it, the part of the latter located downstream of the feed rolls 30 tends to rotate around one of the two feed rolls 30, moving up or down. The curving roll 32 located downstream in this case functions as a contrast roll opposing this rotation, and ensuring the correct execution of the bending.

In accordance with another embodiment of the invention, the curving unit 29 can be selectively mobile, for example in a direction parallel to the axis of rotation Z, between an operative position, in which it protrudes from the work plane 34, and an inoperative position in which it is retracted with respect to the work plane 34 and does not interfere with the oblong element 11 being worked.

According to a possible solution, described for example with reference to FIG. 12, the machine 10 also comprises a drawing unit 26, disposed between the bending device 21 and the curving unit 29 and configured both to move the oblong elements 11, selectively and in both directions, in the direction defined by the longitudinal axis X, and also to clamp the oblong elements 11 under certain circumstances, as will be described later in more detail.

The drawing unit 26 can also be installed on the support structure 19.

The drawing unit 26 comprises at least one, in this case two pairs of drawing rolls 27, in which the opposite rolls of each pair are aligned with the longitudinal axis X and exert an action of moving the oblong element 11.

The presence of a drawing unit 26 downstream of the bending device 21 allows to generate a retention of the oblong element 11, for example preventing a torsion thereof which would lead to a defective product being obtained. Once bending has been performed with the bending device 21, it is therefore possible to retain the oblong element 11 being worked and to move it with the drawing unit, preventing it from twisting on itself, toward the curving unit 29.

In accordance with possible solutions, each pair of drawing rolls 27 can comprise a motorized roll and a pressing counter-roll, which can be driven in a known way to obtain the axial displacement or clamping of the oblong element 11 being worked. The drawing unit 26 too, like the bending device 21, is selectively mobile, for example parallel to the axis of rotation Z, between an operative position, in which its two pairs of drawing rolls 27 protrude from the work plane 34 of the oblong elements 11, to cooperate actively with the oblong element 11 being worked, and an inoperative position, in which the same two pairs of drawing rolls 27 are distanced from the work plane 34, for example they are located under the work plane 34, and do not interfere with the oblong element 11 being worked.

In accordance with another solution, the machine 10 can comprise a command unit 28 configured to coordinate the drive of at least the feed unit 15, 18, of the bending device 21 and of the curving unit 29 to perform both bending and curving operations on the oblong element 11.

According to a possible solution of the invention, the command unit 28 can be associated both with the bending device 21, to command its translation along the transverse axis Y and the rotation of the bending pin 24 to bring it to the desired radial position, and also with the drawing unit 26 and/or the feed unit 15, 18, to selectively command the displacement, or clamping, of the oblong element 11 being worked.

The command unit 28 is also configured to command the selective displacement of both the bending device 21 and the drawing unit 26, independently, or in a synchronized manner, from their active position to their inactive position, and vice versa.

Moreover, in possible embodiments of the invention, the command unit 28, associated with the curving unit 29, is configured to command the reciprocal movement and rotation of the feed rolls 30, the translation of the curving rolls 31 and 32, and the selective displacement of the curving unit 29 from its active position to its inactive position, and vice versa.

The working method of the machine 10, for bending and curving the oblong elements 11 is as follows, and is shown with reference to FIGS. 2 to 11.

If, for example, a 90° bend is to be made in correspondence with the head T of an oblong element 11, the bending device 21 is used. For example, if a 90° bend is to be made upward (FIG. 2), a first working step is performed, or a first bending step, which provides that the bending device 21 is positioned along the transverse axis Y so that its contrast roll 23 is above the axis longitudinal X and tangent to the oblong element 11 to be bent. Moreover, in an initial position, not shown, the bending pin 24 is disposed downward so that the oblong element 11 to be bent can be inserted between the contrast roll 23 and the bending pin 24, thrust in the direction of feed (arrow F1) by the feed unit 15 (FIGS. 1 and 2). Then, by means of the feed unit 15, the oblong element 11 is held stationary and the bending pin 24 is rotated in an anti-clockwise direction until it is brought into the position shown in FIG. 3 and thus carry out the bending with the fixed radius R1.

If subsequently the oblong element 11 is to be curved, for example downward (FIG. 3), a second working step, or first curving step, is performed using the same bending device 21.

In particular, first of all both the bending device 21 and the curving unit 29 are moved to the inoperative position.

The bending device 21 is then moved along the transverse axis Y until the contrast roll 23 is below the longitudinal axis X and tangent to the oblong element 11 being worked. Moreover, also simultaneously, the bending pin 24 is rotated in an anti-clockwise direction to bring it above the longitudinal axis X and tangent to the oblong element 11 being worked. The bending device 21 is then returned to the operative position, while the drawing unit 26 is left in an inoperative position. In this way the oblong element 11 being worked will be located between the counter roll 23, below it, and the bending pin 24, above it.

Figures 3, 4, 5:
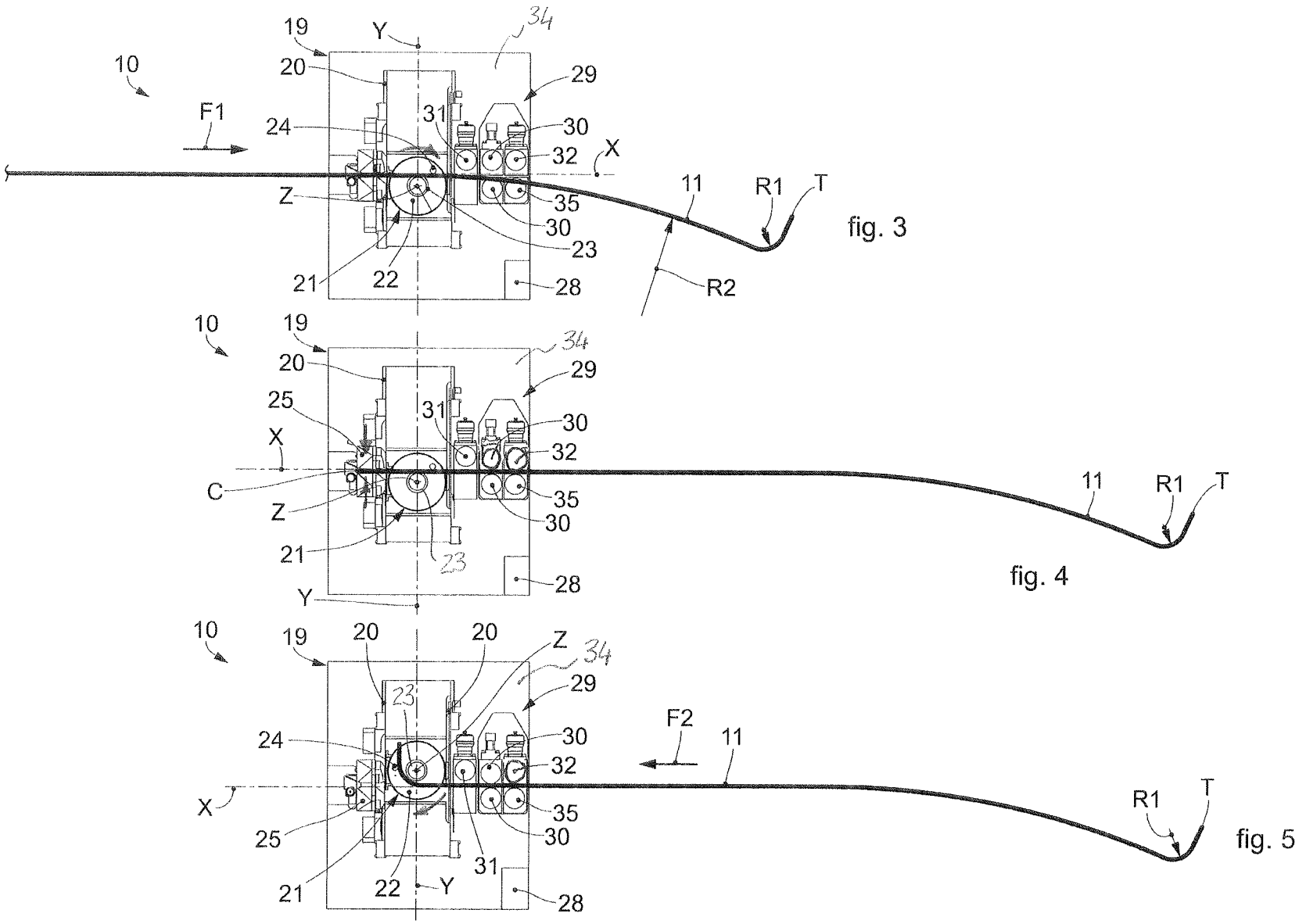

From this position the disc 22 is made to rotate in a clockwise direction by a desired angle, even small, for example comprised between 2° and 15°, so that the bending pin 24 imparts to the oblong element 11 a thrust such as to curve it with a desired radius of curvature R2. The feed unit 15 located upstream is then driven, to feed the oblong element 11 to the right (arrow F1 in FIG. 3), which will thus be curved by the bending device 21. When the curvature is to be interrupted, the bending pin 24 is made to rotate in an anti-clockwise direction so that it no longer interacts actively with the oblong element 11. In the example of FIG. 3 the curvature has been made only on the first part of the oblong element 11, that is, the one close to its head T.

There then follows a third working step, or cutting step, in which the oblong element 11 (FIG. 4) is cut to size by the cutting device 25 in correspondence with its tail end C. During the cutting step the oblong element 11 is held stationary by the feed rolls 30 and by the curving roll 32 and support roll 35.

If, for example, a 90° bend is to be made in correspondence with the tail end C of the oblong element 11 being worked, already bent and partly curved as described above, the bending device 21 is used again and a fourth working step, or second bending step, is performed.

Thus, for example, if a 90° upward bend is to be carried out near the tail end C (FIG. 5), first the bending device 21 is taken to the inoperative position, and from there it is moved along the transverse axis Y, so that its contrast roll 23 is positioned above the longitudinal axis X and tangent to the oblong element 11 to be bent. Furthermore, the disc 22 is rotated so that the bending pin 24 is disposed downward and lies on the transverse axis Y (position not shown in the drawings), so that the oblong element 11 to be bent is then to be found between the contrast roll 23 and the bending pin 24. Then the feed rolls 30 are driven, so that the oblong element 11 being worked is displaced axially along the longitudinal axis X until its tail end C is positioned in correspondence with the counter-roll 23. Then the bending device 21 is also returned to the operative position. The disc 22 is then rotated in a clockwise direction by an angle greater than 90°, until the bending pin 24 is taken into the position shown in FIG. 5 and thus the bend is made in correspondence with the tail end C of the oblong element 11 being worked.

Moreover, by using the curving unit 29 it is also possible to complete the curvature of the oblong element 11 being worked, for example still downward (FIGS. 6, 7 and 8), by performing a fifth working step, or second curving step.

In particular, first of all the bending device 21 is taken to the inoperative position; the curving roll 31 is translated in a direction parallel to the transverse axis Y to deform the oblong element 11. During this step the feed rolls 30 are kept closed pressing on the oblong element 11, thus avoiding an undesired rotation thereof. By driving the feed rolls 30 it is possible to move the oblong element 11 in the direction indicated by the arrow F2 of FIG. 6, while the curving roll 31 deforms the oblong element 11.

Figures 6, 7, 8:
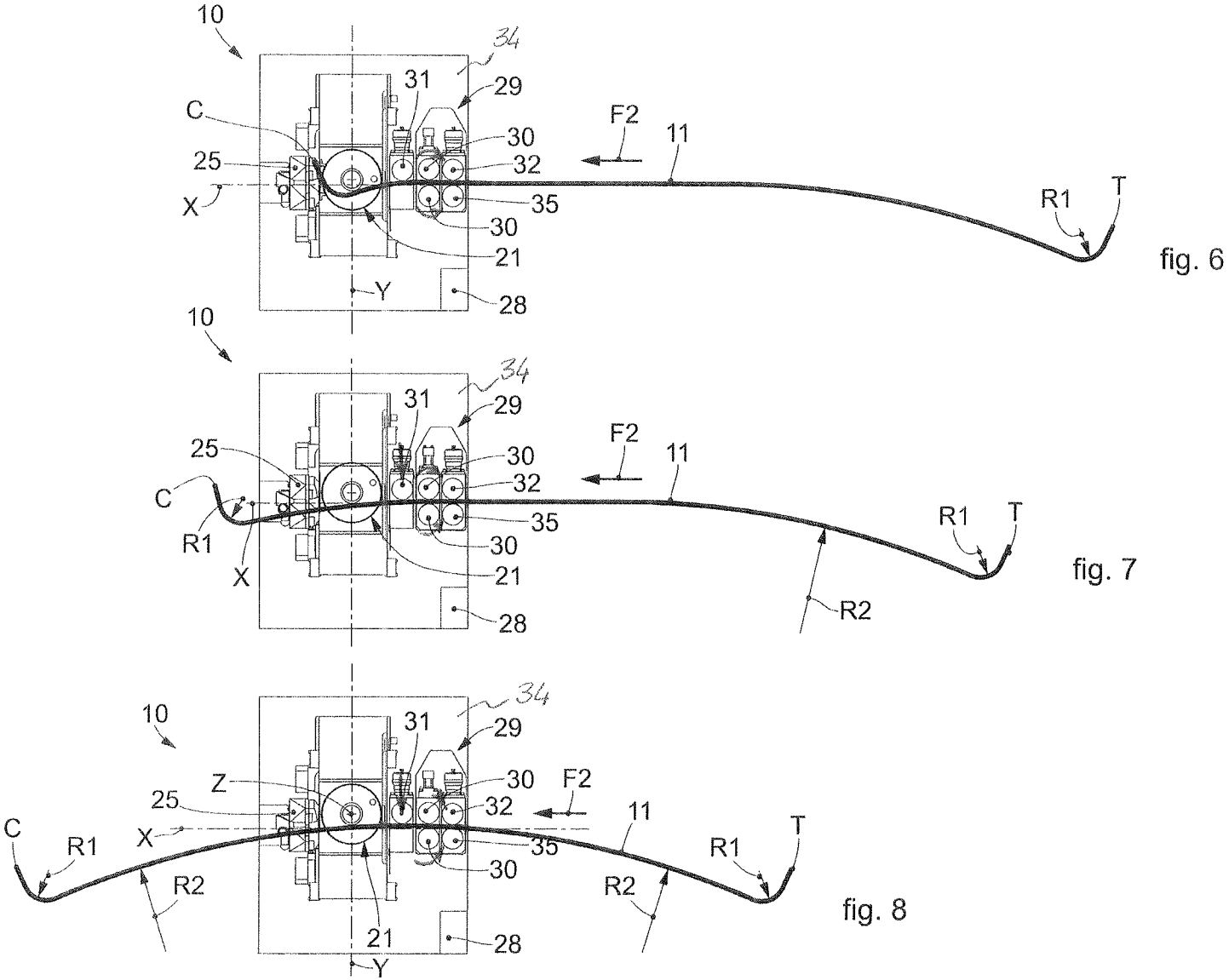

In particular, with reference to FIGS. 6-8, a sequence is shown for making a curvature with a concavity facing downward and in which the curving roll 31 is located above the oblong element 11.

Figures 9, 10, 11:
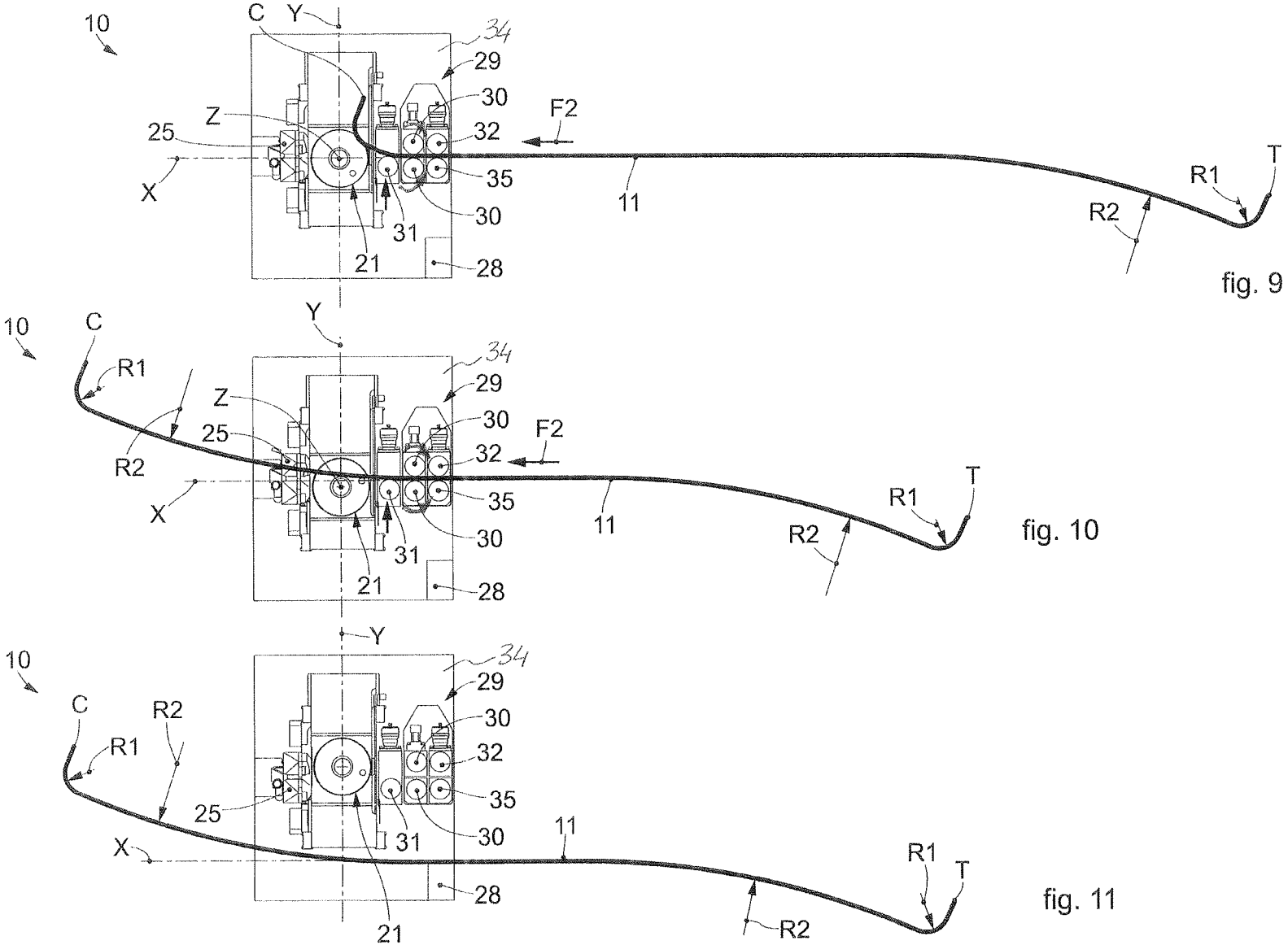

With reference to FIGS. 9-11, instead, a sequence is shown for making a curvature with the concavity facing upward, and in which the curving roll 31 is located under the oblong element 11.

Also with the machine 10 shown in FIGS. 12-20 it is possible to make bends, for example of 90°, in correspondence with the head T or the tail end C, of the oblong element 11 being worked, with the bending device 21, in the manner described above. During these bends, the curving unit 29 is taken into the inoperative position.

The machine 10 allows to curve the oblong elements 11, both with the bending device 21 and also with the curving unit 29.

Therefore, with reference to FIGS. 13 to 20, we will now describe only the working method of the machine 10 for curving an oblong element 11 being worked using the curving unit 29, since we have already described the working steps for curving the same element oblong 11 being worked using the bending device 21.

Figure 13:
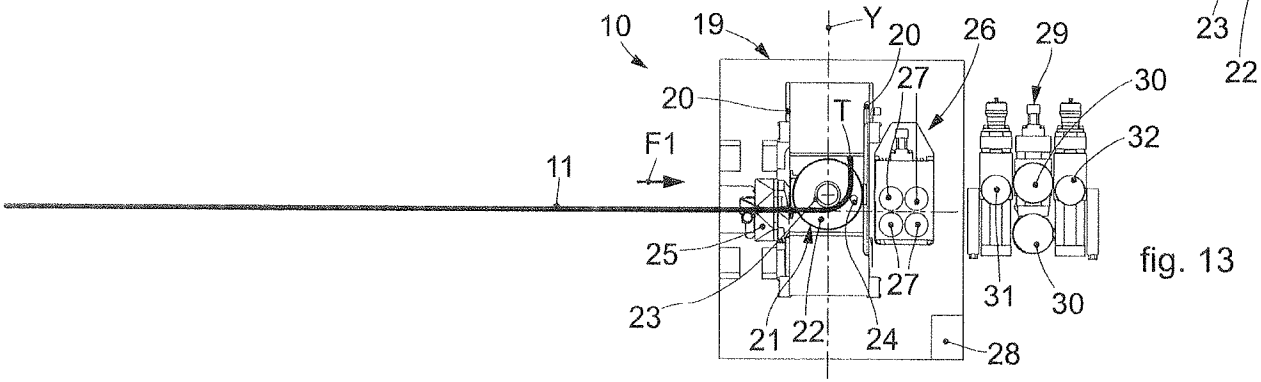
FIGS. 13 to 20 are schematic front views of the machine in FIG. 12, showing other working steps of the same oblong element.
Figure 14:
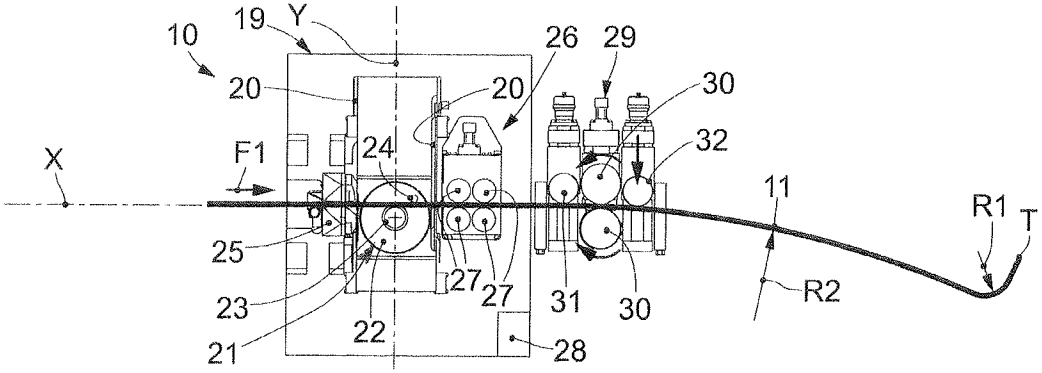

In FIG. 13 it can be seen that in correspondence with the head T of the oblong element 11 being worked, a 90° upward bend has already been made.

If, for example, a downward curve is to be made on the oblong element 11 being worked, using the curving unit 29 (FIG. 14), a seventh working step, or fourth curving step, is performed. In particular, the bending device 21, the drawing unit 26, and the curving unit 29 are taken into the inoperative position. The oblong element 11 is then moved forward toward the right (arrow F1), using the feed unit 18, until the bend in correspondence with the head T passes beyond the right curving roll 32. Then, the curving unit 29 and the drawing unit 26 are taken into the operative position, and in particular the feed rolls 30 and the drawing rolls 27 are taken to grip on the oblong element 11 being worked, and the right curving roll 32 is lowered so that the latter thrusts the oblong element 11 being worked downward and confers upon it the desired curvature, while the same oblong element 11 being worked is made to advance toward the right by the feed rolls 30 and by the drawing unit 26. The radius of curvature of the oblong element 11 depends on the position of the curving roll 32 with respect to the longitudinal axis X. In this case the lower feed roll 30 acts as a contrast roll.

There then follows a cutting step (FIG. 15), in which the oblong element 11 being worked is cut to size by the cutting device 25 in correspondence with its tail end C. During the cutting step the oblong element 11 being worked is held stationary by the feed rolls 30 of the curving unit 29 and by the drawing rolls 27 of the drawing unit 26, while the curving roll 32 is again in its initial position, not active on the oblong element 11 being worked.

If, for example, a 90° upward bend is to be made near the tail end C (FIG. 16), the bending device 21 is used as previously described with reference to the fourth working step, with the difference that the displacement of the oblong element 11 being worked is carried out by the feed rolls 30 of the curving unit 29 and by the drawing unit 26.

Figures 15, 16, 17:
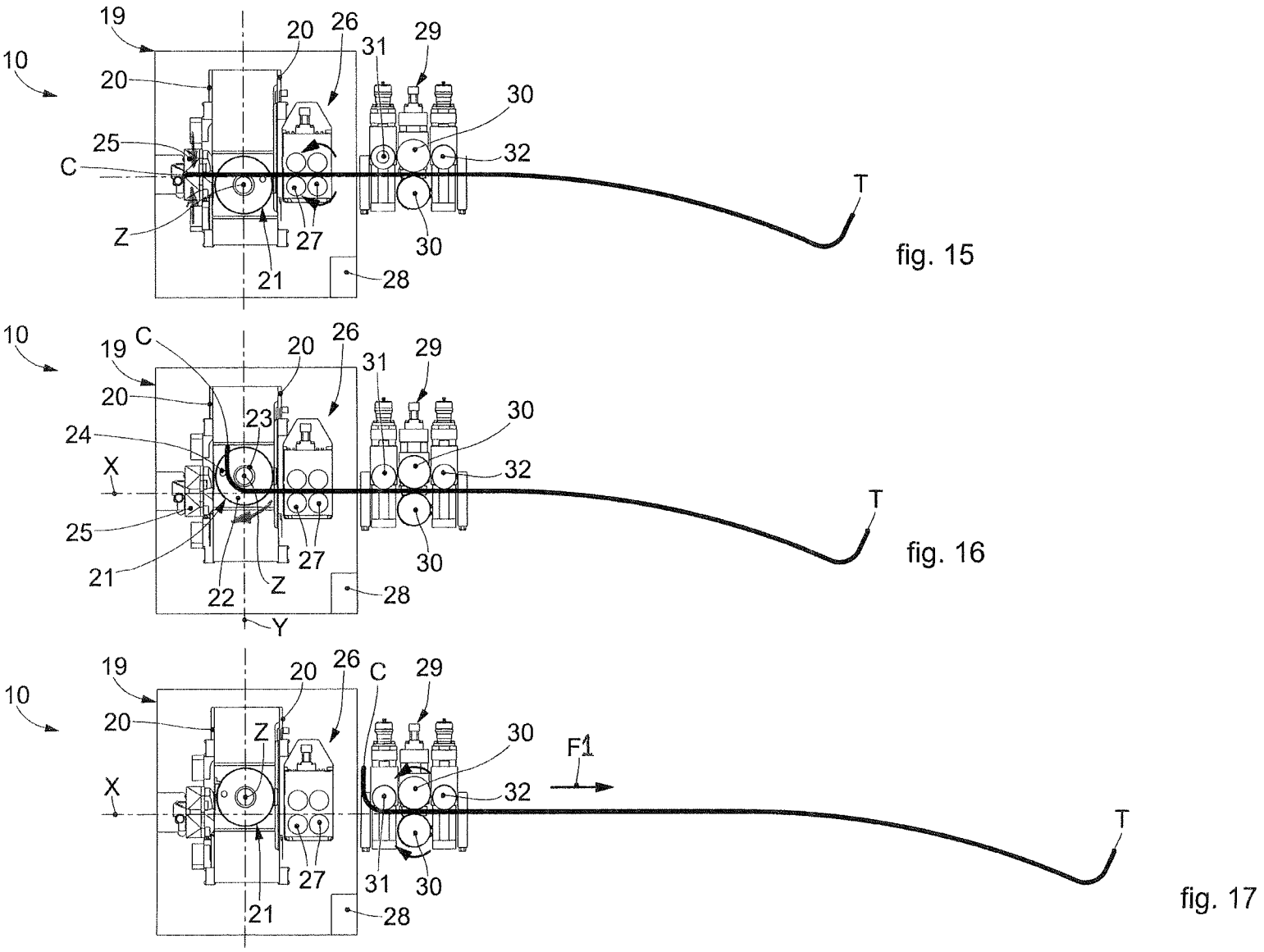
Figure 18:
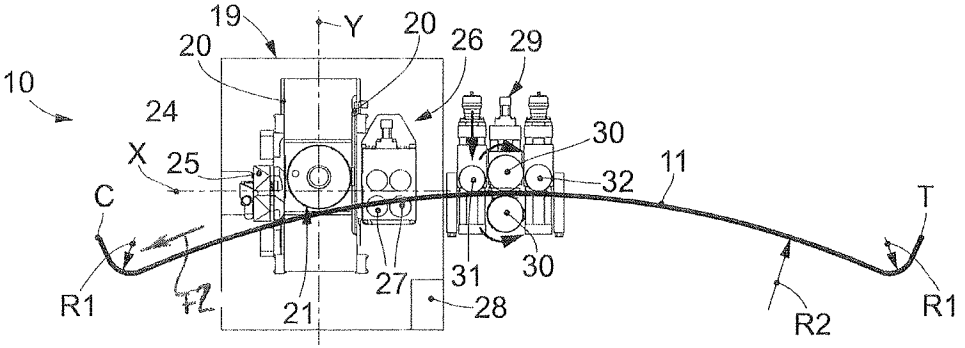
Figure 19:
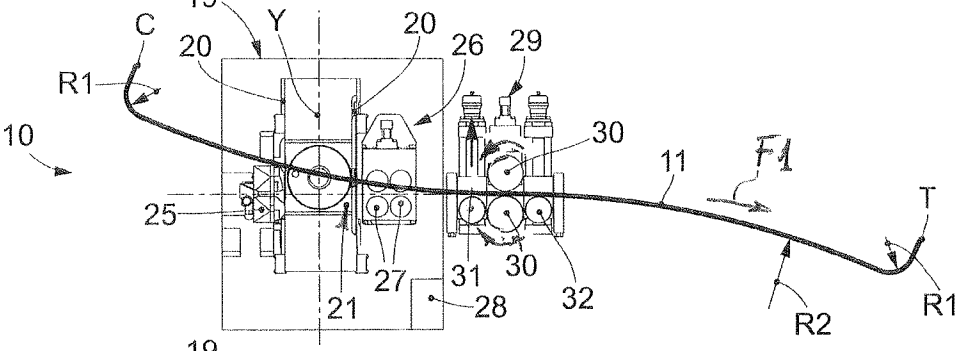

If subsequently, for example, it is desired to complete the downward curvature of the oblong element 11 being worked (FIGS. 17 and 18), an eighth working step is performed, or fifth curving step, during which the bending device 21 is returned to the inoperative position and the oblong element 11 being worked is fed toward the right (arrow F1), using the feed rolls 30 of the curving unit 29, until the 90° bend near the tail end C is close to the left curving roll 31 (FIG. 17). Then, the left curving roll 31 is lowered (FIG. 18) so as to thrust the oblong element 11 being worked downward, curving it with a radius of curvature chosen as desired, and the direction of rotation of the feed rolls 30 is inverted in order to feed the oblong element 11 being worked to the left (arrow F2 in FIG. 18). In this case too, the lower feed roll 30 acts as a contrast roll.

If, for example, instead of completing the downward curvature of the oblong element 11, it is desired to bend it upward (FIG. 19), this can be done by performing a ninth working step, or sixth curving step, again using the curving unit 29, as follows, starting from the position of the oblong element 11 being worked shown in FIG. 15. In this position, the oblong element 11 being worked is clamped using the drawing unit 26, temporarily taken into the active position, the bending device 21 is kept in the inoperative position, and the curving unit 29 is also taken to its inoperative position. The curving rolls 31 and 32 of the latter are then moved downward so that they are completely under the longitudinal axis X. Then, the possible 90° upward bend near the tail end C of the oblong element 11 being worked is made, as described above with reference to FIG. 16, using the bending device 21, after returning it to the operative position. Then the curving unit 29 is taken to the operative position, the feed rolls 30 are driven so that they clamp the oblong element 11 being worked, and the bending device 21 and the drawing unit 26 are taken to their inoperative position. Then the oblong element 11 being worked is fed toward the right (arrow F2), using the feed rolls 30 of the curving unit 29, until the possible bending of 90° near the tail end C is close to the left curving roll of 31, that is, in the same position shown in FIG. 17. Then, the left curving roll 31 is raised so as to thrust upward the oblong element 11 being worked, curving it with a radius of curvature chosen as desired, and the direction of rotation of the feed rolls 30 is inverted so as to feed the oblong element 11 being worked to the left (arrow F2). In this case it is the upper feed roll 30 which acts as a contrast roll.

Figure 20:
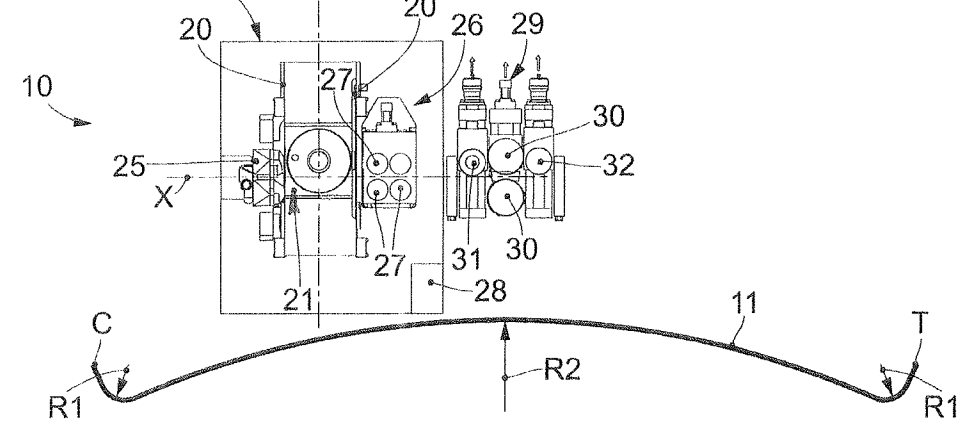

When both the desired bends using the bending device 21 and the desired curves using the curving unit 29 are completed on the oblong element 11, the curving unit 29 is also taken into the inoperative position, so that the oblong element 11 can be removed from the machine 10 (FIG. 20).

Figure 21:
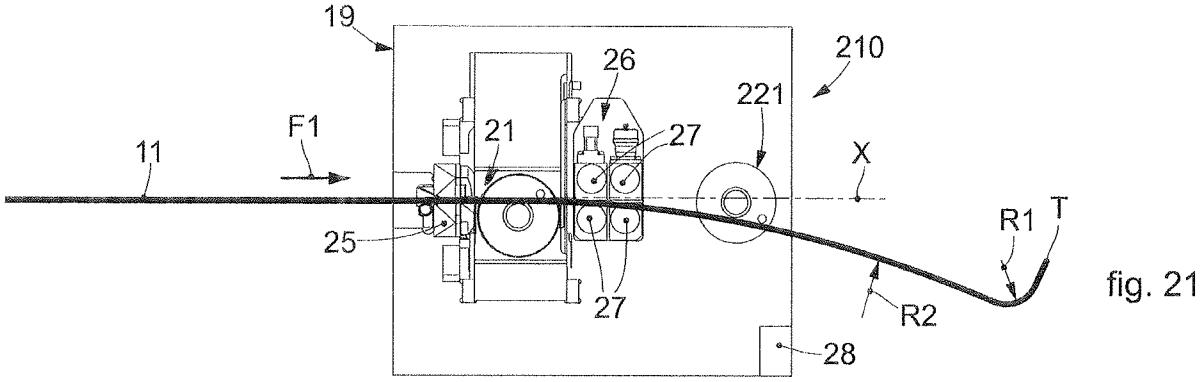
FIG. 21 is a schematic front view of a machine for bending elements according to another embodiment of the invention.

With reference to FIG. 21, a machine 210 according to the present invention, according to a third embodiment, is very similar to the machine 10 described above, with the difference that a second bending device 221 is disposed downstream of the drawing unit 26 and on the same work plane, which also has the function of a curving unit 29, equal to the bending device 21, substantially aligned with the longitudinal axis X and possibly usable together with the bending device 21, under the command of the command unit 28, in order to bend and/or curve an oblong element 11, in the manner described above.

Figure 22:
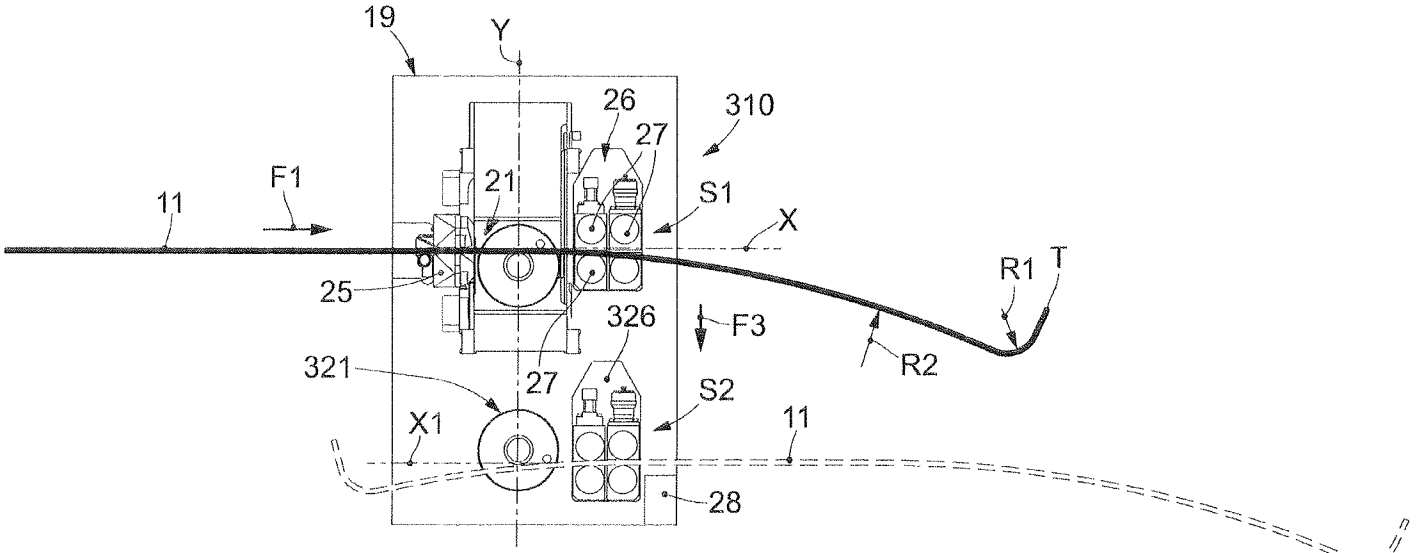
FIG. 22 is a schematic front view of a machine for bending oblong elements according to the present invention and in accordance with a fourth embodiment.

With reference to FIG. 22, a machine 310 according to the present invention, in accordance with a fourth embodiment, is very similar to the machine 10 described above, with the difference that aligned along an axis X1, parallel to the longitudinal axis X, another bending device 321 is disposed, equal to the bending device 21, and another drawing unit 326, equal to the drawing unit 26, also under the command of the command unit 28. In particular, the two bending devices 21 and 321 are aligned on the transverse axis Y.

In this way the machine 310 has two independent and autonomous work stations S1 and S2, one consisting of the bending device 21 and of the drawing unit 26 and the other consisting of the bending device 321 and of the drawing unit 326 in order to bend and/or curve oblong elements 11 also by passing them, for example by means of a movement unit, from one work station to the other, in a direction parallel to the transverse axis Y (arrow F3 in FIG. 22).

It is clear that the two work stations S1 and S2 of the machine 310 can be coordinated with each other to optimize the working steps and times to carry out the various bends and curves on the oblong elements 11.

It should be noted that with the machine 10, 210 or 310 and with the corresponding bending method described heretofore, it is possible both to bend an oblong element 11 with a predetermined radius of curvature (R1), and also to curve the latter, conferring upon it a curvature with radius of curvature chosen as desired (R2), using, if desired, only the bending device 21.

Alternatively, it is possible to use the bending device 21, 221 or 321 to bend the oblong element 11 with a predetermined radius of curvature (R1) and instead use the curving unit 29 to curve the oblong element (11) as desired, conferring upon it any radius of curvature (R2) whatsoever, starting from a minimum radius of curvature, which for example can be equal to said predetermined radius of curvature (R1).

It is clear that modifications and/or additions of parts and/or steps can be made to the machine 10, 210, 310 and the corresponding method for bending oblong elements as described heretofore, without departing from the field and scope of the present invention.

It is also clear that, although the present invention has been described with reference to some specific examples, a person of skill in the art shall certainly be able to achieve many other equivalent forms of machines and/or methods for bending oblong elements, having the characteristics as set forth in the claims and hence all coming within the field of protection defined thereby.

The invention claimed is:

1. A machine for bending oblong elements (11), the machine comprising:

a feed unit (15, 18) configured to feed at least one of said oblong elements (11) along a longitudinal axis (X), a support structure (19) provided with lateral guides (20) parallel to a transverse axis (Y), perpendicular to the longitudinal axis (X), a bending device (21) installed on said support structure (19), selectively translatable along said lateral guides (20), located downstream of said feed unit (15, 18) and provided with a contrast roll (23) and a bending pin (24) selectively rotatable around said contrast roll (23) to at least bend said oblong element (11) around said contrast roll (23), and a curving unit (29) disposed downstream of said bending device (21) and configured to curve said oblong element (11) along part of an oblong development thereof, wherein said curving unit (29) comprises two feed rolls (30) disposed one on one side and one on the other side of said longitudinal axis (X) and configured to move said oblong element (11) along said longitudinal axis (X), in forward and rearward directions (F1, F2), or clamp, or not interfere with said oblong element (11) being worked, and at least one curving roll (31, 32), disposed adjacent to at least one of said two feed rolls (30) and mobile at least in a direction parallel to said transverse axis (Y), to impart a thrust to said oblong element (11) being worked, suitable to curve it with respect to one of said feed rolls (30) and to confer upon it said curvature having a radius of curvature (R2).

2. The machine of claim 1, wherein said curving unit (29) is positioned aligned with said bending device (21) along said longitudinal axis (X).

3. The machine of claim 1, wherein said at least one curving roll (31, 32) of said curving unit (29) comprises two curving rolls (31, 32), one curving roll (31) being disposed upstream of said feed rolls (30) and another curving roll (32) being disposed downstream of said feed rolls (30), along said longitudinal axis (X), each being individually mobile at least in a direction parallel to said transverse axis (Y).

4. The machine of claim 1, further comprising a drawing unit (26) disposed between the bending device (21) and the curving unit (29) and configured both to move the oblong elements (11), selectively and in the forward and rearward directions, along the longitudinal axis (X), and also to clamp the oblong elements (11).

5. The machine of claim 1, wherein the bending device (21), in combination with the feed unit (15, 18), is also configured to perform curving operations on the oblong element (11).

6. A method for bending oblong elements (11) comprising:

feeding, with a feed unit (15, 18), at least one oblong element (11) along a longitudinal axis (X), bending said oblong element (11) around a contrast roll (23) via a bending pin (24) which is made to rotate around said contrast roll (23), said contrast roll (23) and said bending pin (24) being part of a bending device (21) translatable along lateral guides (20) of a support structure (19) and parallel to a transverse axis (Y), perpendicular to the longitudinal axis (X), and curving said oblong element (11) along part of an oblong development thereof, by means of a curving unit (29) located downstream of said bending device (21), wherein two feed rolls (30) of said curving unit (29) are located one on one side and one on the other side of said longitudinal axis (X) and move the oblong element (11) being worked along the longitudinal axis (X), in forward and rearward directions (F1, F2), or clamp, or do not interfere with said oblong element (11), and wherein at least one curving roll (31, 32) of said curving unit (29), disposed adjacent to at least one of said feed rolls (30), imparts to said oblong element (11) a thrust configured to form a curvature with respect to one of said feed rolls (30) in order to confer upon the oblong element (11) said curvature having a radius of curvature (R2), while the oblong element (11) is moved along said longitudinal axis (X).

7. The method of claim 6, wherein the oblong element (11) is positioned in an interspace comprised between the contrast roll (23) and the bending pin (24), and the bending pin (24) is made to rotate with respect to the contrast roll (23), to exert on the oblong element (11) a deformation force in a direction transverse to the longitudinal axis (X), and around the contrast roll (23), and wherein while the bending pin (24) is acting on the oblong element (11), the oblong element (11) is moved in a direction parallel to said longitudinal axis (X), via said feed unit (15, 18), to exert a deformation that extends along at least part of the length of the oblong element (11).

* * * * *